United States Patent [19]

Alexandre

[11] 4,033,460

[45] July 5, 1977

[54] HOLDER FOR SKIS, SKI POLES AND SKI BOOTS

[76] Inventor: Arthur E. Alexandre, 26292 Papagayo, Mission Viejo, Calif. 92675

[22] Filed: Mar. 22, 1976

[21] Appl. No.: 669,142

[52] U.S. Cl. ..... 211/60 SK; 211/35; 211/89

[51] Int. Cl.[2] ..... A47F 7/00

[58] Field of Search ..... 211/60 R, 60 SK, 65, 211/66, 35, 86, 87, 89; 224/45; 280/11.37 K; 70/58

[56] References Cited

UNITED STATES PATENTS

| | | | |
|---|---|---|---|
| 2,284,552 | 5/1942 | Arenz | 211/35 |
| 2,917,182 | 12/1959 | Browne | 211/65 |
| 2,963,165 | 12/1960 | Steiner | 211/60 SK |
| 3,330,573 | 7/1967 | Seiloff | 70/58 X |
| 3,425,567 | 2/1969 | Murray | 211/89 |
| 3,756,420 | 9/1973 | Brown | 211/60 SK |
| 3,893,606 | 7/1975 | Hofmann | 211/60 SK X |
| 3,946,877 | 3/1976 | Galicia | 211/65 |

*Primary Examiner*—Roy D. Frazier
*Assistant Examiner*—Terrell P. Lewis
*Attorney, Agent, or Firm*—Ben E. Lofstedt

[57] ABSTRACT

A holder for mounting a pair of skis, ski poles and ski boots on a wall comprising a bracket having a pair of spaced-apart fingers projecting outwardly from the rearwardly disposed wall means, the wall means being mountable to a mounting wall that allows a pair of skis to be mounted in back-to-back relationship. A pair of sidewardly open vertical recesses, each being complementary formed and adapted to releaseably grip a ski pole, are intermediately disposed on the surfaces of the fingers facing away from the skis and to the outside thereof. One of the fingers extends beyond the end of the corresponding finger and is capped on the upper portion thereof by an arcuate segment with an upwardly projecting, forwardmost edge for receiving the looped portion of a carrier for a pair of ski boots.

9 Claims, 5 Drawing Figures

HOLDER FOR SKIS, SKI POLES AND SKI BOOTS

BACKGROUND OF THE INVENTION

1. Field of the Invention

This invention relates to a bracket for mounting to a wall for holding skis, ski poles and ski boots for storage or display purposes.

2. Description of the Prior Art

Storage of skis, ski poles and ski boots in particularly difficult due to a combination of the unique configuration of these items combined with the rather unwieldy length normally involved with the skis and ski poles. Further, such items present problems in providing secure temporary storage at home or in areas of public accommodation.

The present invention herein disclosed provides a relatively simple, wall-mounted bracket for holding a pair of skis properly and also for holding a pair of ski boots and a pair of ski poles. Simply constructed of plastic, this bracket is available for home or commerical use, and for application where secure storage is desirable.

SUMMARY OF THE INVENTION AND OBJECTS

The instant invention disclosed herein basically comprises a wall-mounted support for a pair of skis, ski poles and ski boots. A bracket is utilized having a pair of spaced-apart fingers projecting outwardly from the rearwardly disposed wall means, the wall means being mountable to a mounting wall that allows a pair of skis to be mounted in back-to-back relationship. A pair of sidewardly open vertical recesses, each being complementarily formed and adapted to releaseably grip a ski pole are intermediately disposed on the surfaces of the fingers facing away from the skis and to the outside thereof. One of the fingers extends beyond the end of the corresponding finger and this extended section is capped on the upper portion thereof by an arcuate segment with an upwardly projecting edge for receiving the looped portion of a carrier for a pair of ski boots.

It is, therefore, an object of this invention to provide a bracket for mounting a pair of skis, ski poles and ski boots on a wall so that the skis, ski poles and ski boots are supported in a position which will not damage the skis or ski poles by bending them or subjecting them to undue stress and to allow the ski boots to be conveniently stored in intimate proximity to the skis and ski poles.

Another object of the present invention is to provide a ski equipment bracket whereupon ski boots may be suspended above the floor for more rapid and complete drying thereof following the use of the ski boots.

A yet still further and primary object of the instant invention is to provide a bracket of the type herein characterized which is capable of being constructed using low-cost production techniques and designed to provide neat and secure storage of said ski equipment.

Another important object of the subject invention is to provide a relatively inexpensive bracket for holding skis, ski poles and ski boots which is adapted to mass marketing.

These and further objects will become even more evident from the following disclosure, taken in conjunction with the accompanying drawings which illustrate one preferred form of the present invention.

BRIEF DESCRIPTION OF THE DRAWING the drawing furnished herewith illustrates the best modes presently contemplated by the inventor and clearly discloses the above advantages and features, as well as others which will be readily understood from the detailed description thereof.

DESCRIPTION OF THE PREFERRED ILLUSTRATED EMBODIMENT

Figure 1:
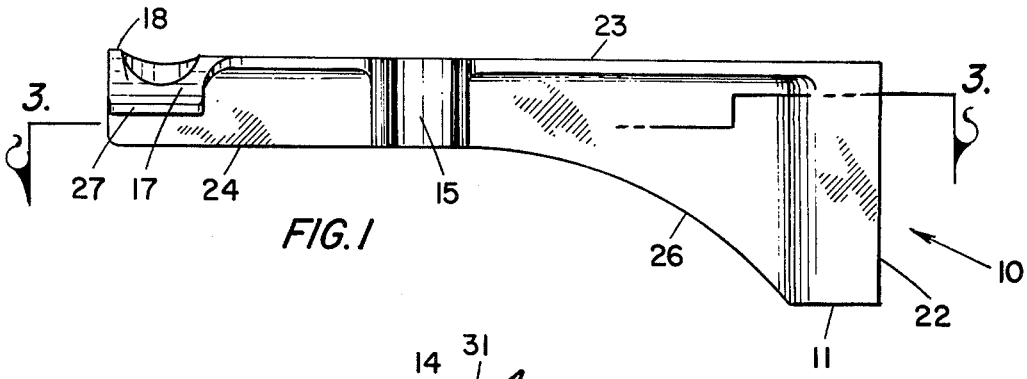
FIG. 1 is a side elevational view of the present invention shown partially in section.
Figure 2:
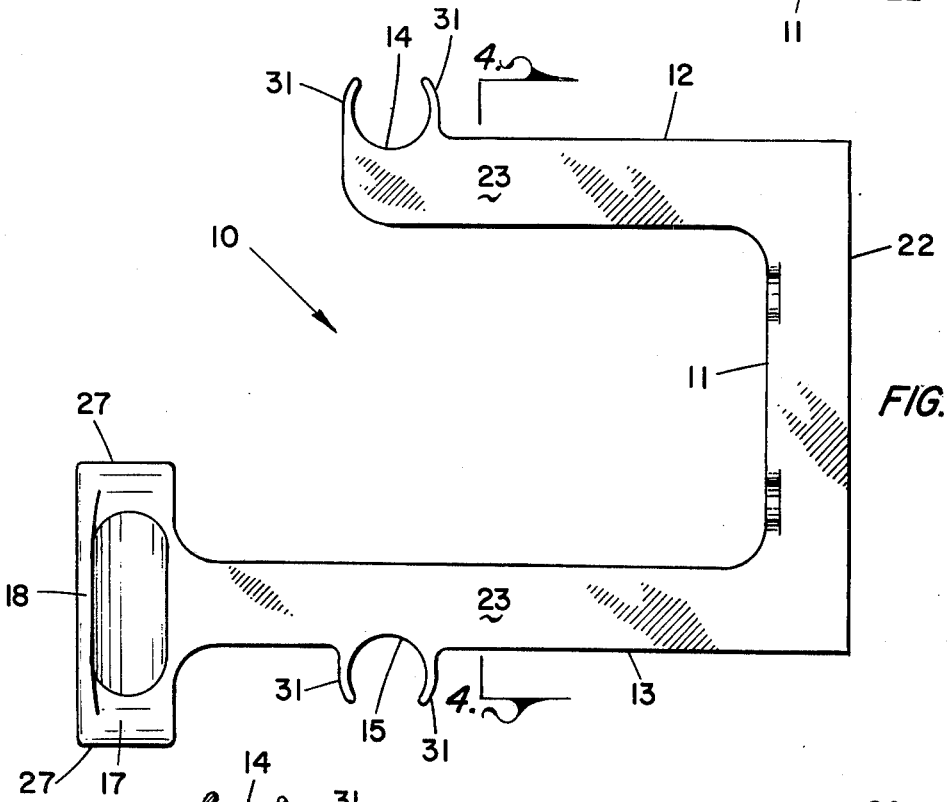
FIG. 2 is a plan view of the present and preferred embodiment of the invention disclosed herein.
Figure 3:
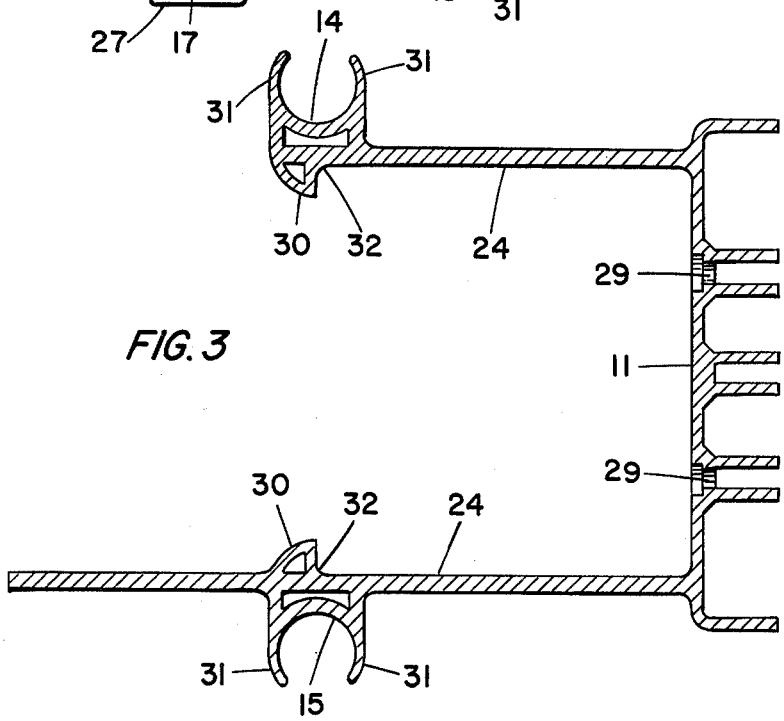
FIG. 3 is a view taken along Plane 3—3 of FIG. 1 of the instant invention.
Figure 4:
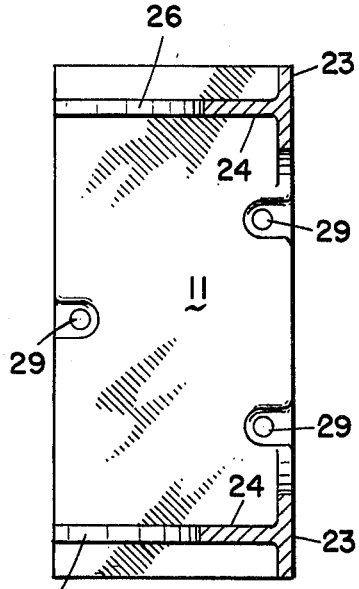
FIG. 4 is a view taken along Plane 4—4 of FIG. 2 of this embodiment of the present invention.

With continuing reference now to the Drawing and the various Figures shown therein, the holder is shown in the form of a wall bracket generally designated by the numeral 10. Basically, the bracket 10 comprises a rear wall 11 adapted to be mounted to a vertically-disposed wall, a pair of laterally spaced fingers 12,13 projecting forwardly from the rear wall 11 and having a pair of sidewardly open, complementarily formed, vertical recessed portions 14,15, each portion 14,15 being adapted so as to releaseably grip and hold a ski pole and disposed intermediate the sides of the fingers 12,13 and facing to the outside thereof, one of the fingers 13 extending beyond the forwardmost end of the corresponding finger 12 and being capped on the upper portion 16 of this extended section by an arcuate segment 17 having an upwardly projecting, forwardmost edge 18 thereon.

Figure 5:
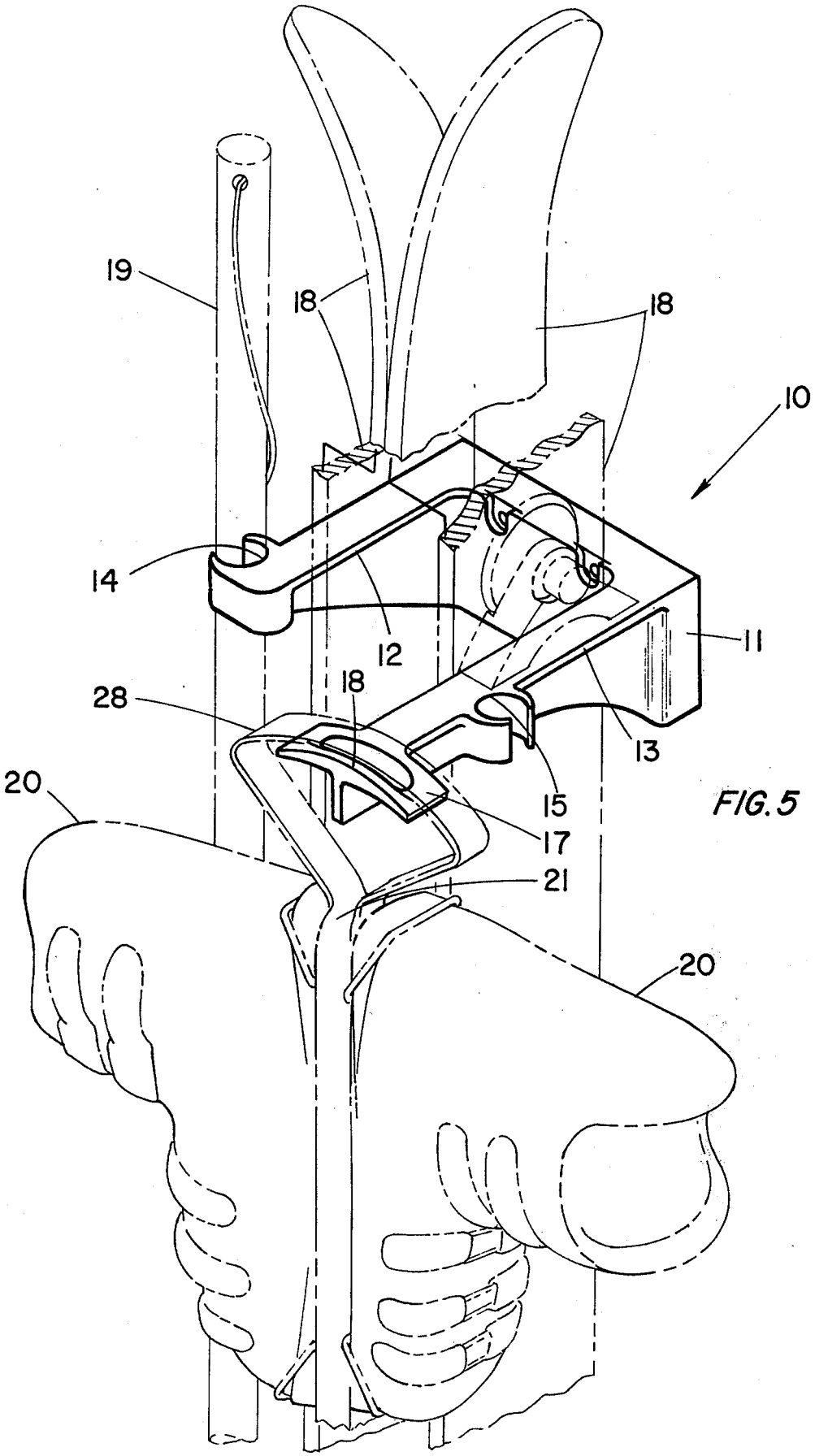
FIG. 5 is a perspective view of the present invention depicting the application and use relative to the support and storage of ski equipment and apparatus.

With particular emphasis now on FIG. 5, the bracket 10 is designed to be secured to a wall at approximately the mid-position of a pair of skis 18 and ski poles 19. The ski boots 20 are supported by the bracket via a conventional ski boot carrier 21. In general, the bracket 10 is adapted to support a pair of skis 18 in spacedapart, back-to-back positions. The skis 18, ski poles 19 and ski boots 20 are supported above the floor, rather than permitting the lower ends of the skis 18 or ski poles 19 to rest upon the surface of the floor (not shown). It should be noted, at this time, that this off-the-floor arrangement is achieved without the need for additional, dependent or independent, support structures for the aforementioned ski equipment.

The specific details of the bracket 10 are best seen in FIGS. 1 through 4. In these figures, the bracket 10 is shown as a fabricated, unitary structure typically formed of plastic in the conventionally utilized plastic molding process.

It should, however, be clearly noted at this time that the details of the construction of this particular embodiment of the present invention, including the use of plastic material formed as an integral structure, is only by way of example. The bracket 10 can be cast from metal or metal alloys as a single structure. It can also be fabricated of wood. Further, the bracket 10 is not required to possess partially hollow portions as indicated and could as easily and readily be formed of solid material if so desired.

The bracket 10, as briefly described previously, basically comprises a rear wall 11 having an upright back surface 22. The plane surface 22 serves as a wall mounting surface, typically being secured thereto in the fashion hereinafter described, in intimate and direct abuttment with a vertically-disposed wall surface when the bracket 10 is properly mounted thereon.

The bracket 10 has a pair of laterally-spaced fingers 12,13 formed as an integral part of the rear wall along the outer edges thereof and projecting forwardly therefrom. Typically, the fingers 12,13 have an upper portion 23 and a lower portion 24. The upper portion 23 and the lower portion 24 are combined so as to form a cross-section having a T-configuration, wherein the upper portion 23 forms the top or horizontal section of the T and the lower portion 24 forms the body or vertical section of the T. This T cross-sectional configuration greatly increases the weight supporting capabilities of the fingers 12,13. Further, as clearly depicted in FIG. 5, relatively wider horizontal upper portion 23 of this T serves as an appropriate supporting surface for the toe gripping portion of the ski boot binding 25, which, in turn, allows the individual ski 18 to be correspondingly supported therefrom.

Turning our attention now specifically to FIG. 1, the lower portion 24 of the T is mated full width across the outer edges of the rear wall 11 and, as it is projected forwardly, the lower extremity is arcuately curved at 26 upwardly to a point intermediate the finger 12,13, so that at the termination of the curved lower extremity, the width of the lower portion 24 is approximately one-half the width of the rear wall 11.

At the forwardmost extremity of the finger 12 there is formed a sidewardly open, vertical recessed portion 14, the inside surface of which is contoured so as to releaseably grip and hold a ski pole 19 as depicted in FIG. 5. Laterally displaced, in complementary fashion, intermediate the finger 13 is a similar recessed portion 15, also designed to releaseably grip and hold the other of the pair of ski poles 19.

At the forwardmost extremity of the finger 13 an arcuate segment 17 is transversely disposed across the finger 13. The sidewardly facing ends 27 of the segment 17 face downwardly. Along a substantial portion of the forwardmost portion of the segment 17 is a upwardly-directed, raised edge 18. The purpose of this edge 28 is to prevent the looped portion 28 of the ski boot carrier 21 from sliding forward and falling from the segment 17 of the supporting finger 13.

The rear wall 11 of the bracket 10 is typically and conveniently secured to the vertical mounting wall (not shown) via conventional wall-anchoring fasteners, such as screws, expandable fasteners, nails and the like, via the appropriate reinforced fastener passageways 29 in the rear wall 11.

Appropriate reinforcing means 30 are also provided for strengthening and stiffening the recessed portions 14,15 which support the ski poles 19. In this particular embodiment of the present invention, as the sidewall members 31 are forced apart as the ski pole 19 is pressed into gripping engagement therewith the plastic material forming the lower (vertical portion 24 at 32 is urged to move in a side-to-side fashion. Such movement over a period of repeated ski pole engagements and disengagements therewith would cause the equipment supporting fingers 12,13 to weaken and, in time, perhaps, craze and/or fracture, thereby allowing the ski equipment to fall therefrom to the floor. To prevent such flexure at this point and to distribute equally such flexure between the accomodating flexture limits of the sidewall members 31, the reinforcing means 30 is utilized and positioned as emphasised in FIG. 3, on the lower portion 24 of each of the fingers 12,13.

It is to be noted that the bracket 10 is so constructed and arranged so that any piece of the ski equipment organized and supported thereby can be separately and individually removed without the necessity of sequentially removing one or more of the other pieces of ski gear prior to being able to remove the piece of ski equipment desired.

The bracket 10 provides efficient storage of not only skis 18 and ski poles 19, but of the ski boots 20, as well. Further, such is accomplished by utilizing a minimum amount of wall space. Construction, as depicted, is simple and is principally designed for low cost, mass production. Also, the bracket 10 can be proportioned so as to be universally adaptable to skis and ski poles and ski boots of all sizes and construction and does not require the use of any additional storage or support elements, such as the end clamps for the skis described in U.S. Pat. No. 2,956,812 (Lundquist) or the suitably positioned bottom shelf bracket for supporting the lower ends of the skis and poles as required and disclosed by the invention in U.S. Pat. No. 3,425,567 (Murray).

The bracket 10 is suitable for holding the skis, ski poles and ski boots in a home, hotel or motel, a ski lodge, a dormitory, a ski shop, a retail store, a rental equipment area, etc.. In short, it can be efficiently and desirably used in any location where the temporary or permanent storage or skis is desired.

The holder or ski equipment organizer described herein provides a neat, efficient and compact storage arrangement for maintaining skis and poles and boots in an upright position so that the skis are safely supported and the proper ski camber maintained. Minor modifications in the structural features illustrated will be obvious to one skilled in this art, and it is to be understood that such changes are encompassed within the claims appended hereto.

Having thus described my invention, I claim:

1. A wall bracket for supporting a pair of skis, ski poles and ski boots mounted to a ski boot carrier off the floor, comprising:

wall means disposed at the rear of the bracket;

a pair of fingers secured to the wall means and projecting forwardly therefrom at least the width of a ski and laterally spaced at least twice the thickness measured from the top of the ski to the underside of the ski for vertically supporting a pair of skis via the front ski boot binding positioned thereon;

ski pole gripping and holding means secured to each of the outside and sidewardly facing portions of the pair of fingers for releaseably gripping and holding a ski pole in vertical disposition; and one of the fingers being longer than the other finger and having means disposed on the longer finger adjacent the forwardmost end of the finger whereupon a ski boot carrier may be hung.

2. The wall bracket of claim 1 wherein the wall means disposed at the rear of the bracket includes a plurality of passageways therethrough for receiving fasteners therein for securing the wall means to a mounting wall.

3. The wall bracket of claim 1 wherein the fingers have a T shaped cross-section.

4. The wall bracket of claim 3 wherein the horizontal portion of the T shaped cross-section forms the top of the fingers.

5. The wall bracket of claim 1 wherein the ski pole gripping and holding means comprises a pair of sidewardly open, vertical recessed portions in the fingers, the inside surface of which is contoured in like fashion to the ski pole and the sidewalls of which are flexibly movable in sidewardly displaceable fashion.

6. The wall bracket of claim 5, further comprising reinforcing means secured to each of the opposite sides of the fingers behind the recessed portions thereof to strengthen and stiffen the body of the finger therebetween and to reduce crazing and fracturing thereof due to repeated sidewall flexures of the ski pole gripping and holding means which occurs during engagement and disengagement of the ski poles therewith.

7. The wall bracket of claim 1 wherein the means disposed on the longer finger adjacent the forwardmost end of the finger whereupon a ski boot carrier may be hung comprises an arcuate segment transversely disposed across the longer finger with the sidewardly facing ends of the segment being directed downwardly towards the floor.

8. The wall bracket of claim 7 wherein the arcuate segment further includes along a substantial portion of the forwardmost portion of the segment an upwardly directed, raised edge to prevent the ski boot carrier from sliding therefrom and onto the floor.

9. The wall bracket of claim 8 wherein the wall bracket comprises a unitary, single piece structure formed of plastic material.

* * * * *